United States Patent [19]

Lorenzen

[11] 3,999,134

[45] Dec. 21, 1976

[54] METHOD AND APPARATUS FOR MEASURING THE DENSITY OF FILLING MATERIAL IN ROD-SHAPED SMOKERS' PRODUCTS TAKING INTO ACCOUNT THE MOISTURE OF THE FILLING MATERIAL

[75] Inventor: Heinz-Christen Lorenzen, Hamburg, Germany

[73] Assignee: Hauni-Werke Korber & Co. KG, Hamburg, Germany

[22] Filed: Aug. 12, 1975

[21] Appl. No.: 604,070

[30] Foreign Application Priority Data

Aug. 31, 1974 Germany ..... 2441332

[52] U.S. Cl. ..... 328/4; 324/61 R; 131/21 B; 73/73

[51] Int. Cl.[2] ..... A24B 9/00

[58] Field of Search ..... 328/4; 324/61 R; 131/21 B; 73/32 R, 37.6, 73

[56] References Cited

UNITED STATES PATENTS

| | | | |
|---|---|---|---|
| 2,782,367 | 2/1957 | Dallas | 328/4 X |
| 3,155,901 | 11/1964 | Hanken | 73/73 X |
| 3,738,376 | 6/1973 | Labbe et al. | 131/21 B |
| 3,743,930 | 7/1973 | Fathauer | 324/61 R |
| 3,824,477 | 7/1974 | Cotton | 328/4 |

*Primary Examiner*—John S. Heyman
*Attorney, Agent, or Firm*—Peter K. Kontler; John Kurucz

[57] ABSTRACT

For each rod-shaped article or group of articles there is generated a respective first signal dependent upon both the density and the moisture of the filling material. There is also generated a second signal dependent upon the moisture of the filling material. The first and second signals are processed to form for the respective articles respective third signals dependent upon the mass of the filling material but not exhibiting the moisture dependency of the corresponding first signals. The second signal is generated by determining from the generated third signals which of the articles are defective because they contain insufficient filling material and which are non-defective because they contain sufficient filling material. An average signal is derived from only those first signals derived from non-defective ones of the articles. The second signal is derived from the average signal.

14 Claims, 2 Drawing Figures

METHOD AND APPARATUS FOR MEASURING THE DENSITY OF FILLING MATERIAL IN ROD-SHAPED SMOKERS' PRODUCTS TAKING INTO ACCOUNT THE MOISTURE OF THE FILLING MATERIAL

BACKGROUND OF THE INVENTION

The invention relates to a method and apparatus for measuring by capacitive means the tobacco density of the ends of rod-shaped articles which constitute or form parts of smokers' roducts, such as regular cigarettes, filter cigarettes, cigars, cigarillos, and the like. More particularly, the invention relates to that type of method and apparatus wherein a defect signal is generated if the measured tobacco density deviates from a preselected standard.

The invention furthermore relates to an arrangement for testing the tobacco density in the ends of rod-shaped articles, particularly cigarettes or other smokers' products or components thereof, using a capacitive measuring arrangement and a comparator device operative for generating a defect signal if the measurement indicates a deviation from a preselected tobacco density.

With known capacitive methods for determining the tobacco density in the ends of cigarettes, the measurement signals produced as a result of the testing are dependent not only upon tobacco mass but also upon tobacco moisture. It is true that the tobacco moisture variatons encountered during the manufacture of cigarettes are not very great; however, over long stretches of time they can lead to inaccuracy of the tobacco mass indication. For exmample, a cigarette end containing too little tobacco may not be recognized as being defective if the tobacco moisture is high; likewise, a cigarette end containing a proper amount of tobacco may be mistakenly recognized as being defective if the tobacco moisture level is particularly low.

SUMMARY OF THE INVENTION

It is accordingly an object of the inveniton to provide a capacitive method for testing the ends of cigarettes, and other smokers' products and components therof, and other analogous rod-shaped articles, the method being such that long-term tobacco moisture changes are detected and taken into account in the tobacco density measurement.

This object, and others which will become more understandable from the description, below, of preferred embodiments, can be met, according to one advantageous concept of the invention, by forming a first signal dependent upon both the tobacco density and the tobacco moisture, by forming a second signal mainly dependent upon tobacco moisture, and by processing the first and second signals together to form a third signal dependent upon tobacco moisture to a much lesser extent and upon tobacco mass to a much greater extent than was the first signal, and ideally dependent substantially exclusively upon tobacco density or mass. Preferably, the second signal is formed by forming the average of a sum of first signals associated with respective non-defective rod-shaped articles, or by forming the average of a sum of signals derived from first signals associated with respective non-defective rod-shaped articles. First signals derived from defective articles, or signals derived from first signals derived from defective articles, are excluded from the averaging operation, The second signal can be indicative, for example have a magnitude indicative, of the absolute tobacco moisture level or alternatively can be indicative only of tobacco moisture fluctuations.

According to a preferred concept, tobacco moisture fluctuations are detected by forming the average of the third signals, so that the second signals will be dependent upon this average.

In order to exclude from the averaging operation exclusively those signals which are derived from articles having a truly too-low tobacco density—i.e., taking into consideration tobacco moisture fluctuations, if any—the invention further contemplates excluding a signal after comparison of the third signal with a reference value, by generating when appropriate a defect signal which prevents transmission of the first or third signal to the averaging device.

To assure that after an interruption of the feeding of articles to the testing arrangement the tobacco moisture level is taken into account immediately upon resumption of article feed and testing, the invention further contemplates making the second signal independent in its duration from the manner of its generation; for example, the second signal can be an indefinitely persisting signal immediately available upon resumption of article feed and testing, no matter how long the preceding interruption in the feed and testing has lasted.

According to a preferred concept, the aforementioned third signal corresponds to the quotient of the aforementioned first and second signals. The average value is formed directly from the first signals, with first signals derived from articles having a too-low tobacco density excluded from the averaging operation.

The apparatus for performing the aforedescribed method includes a signal generator for generating a first signal dependent both upon tobacco mass or density an upon the tobacco moisture level, and an averaging device connected to the generator of the first signal through an intermediate circuit arrangement. The averaging device is used to generate the aforementioned second signal, and is connected to a comparator device, with the circuit so designed as to prevent signals derived from articles having an insufficient tobacco density from being transmitted to the averaging device. A signal processing arrangement receives and processes the first and second signals, to form third signals not exhibiting the tobacco moisture dependency of the first signals.

According to one concept of the invention, the transmission of signals derived from articles having insufficient tobacco density to the averaging device is prevented by connecting the input of the averaging device to the output of the signal processing arrangement via an intermediate circuit arrangement operative for transmitting the third signals to the averaging device only if the third signals are associated with non-defective articles.

It may be course happen that the testing will be interrupted for a considerable period of time, for example at the end of a work day. To assure that, immediately upon resumption of the testing, the tobacco moisture level is taken into account, the invention further contemplates generating the aforementioned second signal using a signal generator which generates an indefinitely persisting output signal which is available immediately upon the resumption of testing, no matter how long the interruption of testing has lasted. This output signal is controlled in dependence upon moisture fluctuations by controlling the last-mentioned signal generator using an adjusting motor connected to the averaging device via an evaluating circuit arrangement.

The invention is particularly well suited for the testing of rod-shaped smokers' products or comonents thereof, or the like, during their manufacture, for example, it can be provided at the output end of a filter attaching machine. In order to be able to reliably test a series of articles, use is made of a synchronizer which synchronizes the travel of the articles to be tested with the operation of the testing circuit arrangement.

According to another concept of the invention, as an alternative to the apparatus described above, the signal processing arrangement can be a dividing circuit. In both embodiments, moisture fluctuations are taken into account, and the detection of defective articles is accomplished by connecting the signal generator for the first signal, via the signal processing arrangement, to the comparator arrangement.

According to another concept of the invention, the articles to be tested are transported on a testing conveyor on which the articles travel transverse to their elongation, and the capacitive measuring arrangement includes at least two stationary electrodes, connected with a high-frequency voltage source, and so positioned relative to the ends of the travelling cigarettes that at each moment at which a measurement operation is performed the lines of the alternating electric field joining the electrodes pass through the end of the cigarette to be tested.

The novel features which are considered as characteristic for the invention are set forth in particular in the appended claims. The invention itself, however, both as to its construction and its method of operation, together with addditional objects and advantages thereof, will be best understood from the following description of specific embodiments when read in connection with the accompanying drawing.

DESCRIPTION OF THE PREFERRED EMBODIMENTS

Figure 1:
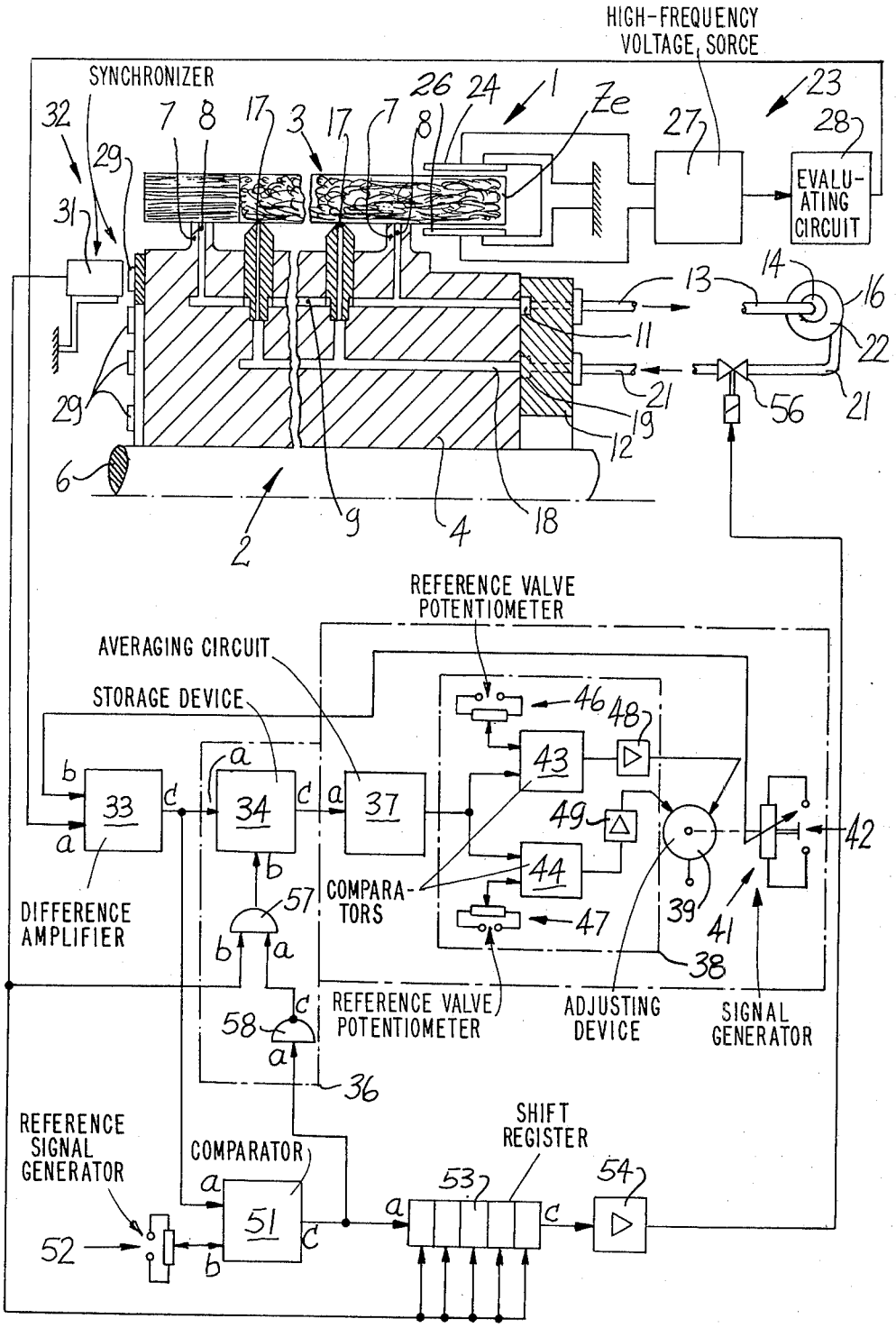
FIGS. 1 and 2 depict two different exemplary embodiments of the invention.

FIG. 1 schematically depicts a capacitive cigarette-end testing arrangement 1 for rod-shaped articles, in the illustrated case filter cigarettes 3, conveyed by an endless rotating test conveyor 2, shown here in a partial sectional view. The test conveyor 2 is comprised of a drum body 4 provided with a drive shaft 6 via which the drum body 4 is continuously rotated. The drum body 4 is provided with holding portions 7 for the filter cigarettes 3. The holding portions 7 at their radially outer ends have recesses shaped to complementarily receive the cigarettes 7. Each holding portion 7 is provided with an internal conduit 8 which communicates, via a conduit 9 and a control slot 11 provided on a stationary control ring 12, with a suction conduit 13 leading to the suction side 14 of an air pump 16. Also provided in the holding portions 7 are conduits 17 which communicate, via conduits 18 and control slots 19 in the stationary control ring 12 with a pressure conduit 21 leading to the pressure side 22 of the air pump 16.

The cigarette ends *Ze* extend axially past the holding portions 7. In the region of the cigarette ends *Ze*, there is provided a capacitive measuring arrangement 23 provided with two electrodes 24, 26 which are stationary with respect to the test conveyor 2. The two electrodes 24, 26 are connected to the terminals of a high-frequency voltage source 27. The positions of the electrodes 24, 26 at opposite sides of the cigarette ends *Ze* moving therebetween are such that each cigarette end, at the measurement moment, i.e., at the moment in which the cigarette end is located exactly between the electrodes 24, 26, will be penetrated by the high-frequency electric field extending between the electrodes.

Associated with the high-frequency voltage source 27 is a signal generating circuit having the form of an evaluating device 28 for determining the mass of tobacco in the tested cigarette end *Ze*. The high-frequency voltage source 27 and the evaluating device 28 can be of any of a variety of per se conventional designs. In the illustrated embodiment, the electrodes 24, 26 constiute the electrodes of a capacitor serving as the frequency-determining component of a per se conventional high-frequency voltage-output oscillator. The tobacco (or other material) and air in the cigarette end *Ze* intermediate the electrodes 24, 26 constitute the capacitor dielectric, so that the capacitance of the measuring capacitor is dependent both upon the mass or density of the tobacco and upon its moisture.

To detect frequency changes attributable to deviations of the tobacco mass in the cigarette ends *Ze* from a desired value, use is made of an evaluating device in the form of an electrical circuit, for example the phase-locked-loop circuit ME 560 B made by the Signatics Corporation. This circuit is operative for generating an output voltage dependent upon frequency variations.

Arranged on the test conveyor 2 are synchronizing members 29 which cooperate with a proximity detector 31 to form a synchronizer 32 for generating synchronizing signals at the testing moments. The proximity detector 31 will generate an electrical control pulse whenever a cigarette 3 finds itself exactly in the measurement position intermediate the electrodes 24, 26.

The evaluating arrangement 28 is connected to the input *a* of a signal processing arrangement having the form of a difference amplifier 33 (analog comparator) whose output *c* is connnected to the input *a* of a controllable storage device 34 (e.g., the sample-and-hold amplifier manufactured by the National Semiconductor Corporation and sold under the trade designation LH 0023). The controllable storage device 34 forms part of a circuit arrangement 36 for preventing the transmission of signals derived from cigarette ends, containing too little tobacco.

A second signal dependent mainly upon the moisture of the tobacco of the filter cigarette 3 is generated by means of an averaging circuit 37 (for example a simple RC-circuit such as a one-resistor, one-capacitor low-pass filter), an evaluating circuit 38, an adjusting device 39, and a controllable signal generator 41 energized by a voltage source 42. The combination of the adjusting device and the controllable signal generator is available as a single component known in the trade as a "Motorpotentiometer", manufactured for example by the Megatron Corporation of Munich, Federal Republic of Germany; it is comprised of a D.C. motor type 15255, a transmission type FMM 15 and a rotary potentiometer type AL 2510. The averaging circuit 37 has its input a connected to the output c of the controllable storage device 34, whereas its output is connected to the input of the evaluating circuit 38. The latter is comprised of two comparators 43, 44 (for example type LM 311 made by the National Semiconductor Corporation), each provided with a respective reference-value potentiometer 46 or 47 and with a respective power amplifier 48 or 49.

The comparator circuits are so interconnected that the comparator 43 generates an output signal when the output signal of the averaging circuit 37 exceeds a certain positive value (e.g., +1 volt), whereas the comparator 44 generates an output signal when the output signal of the averaging circuit 37 falls below a certain negative value (e.g., −1 volt). In the former instance, the comparator output amplifier 48 energizes the adjusting motor 39 in a sense increasing the output voltage of the signal generator 41 (the potentiometer wiper voltage), whereas in the latter instance the comparator output amplifier 49 energizes the adjusting motor 39 in a sense decreasing the output voltage of the signal generator 41. The change of the output voltage of signal generator 41 effected by the adjusting motor 39 occurs relatively slowly, for example because the motor output shaft and the rotary-potentiometer input shaft are interconnected by a speed-reducing transmission having a high input/output speed ratio.

The signal generator 41 has its output (potentiometer wiper) connected to the input *b* of the difference amplifier 33. The output *c* of the difference amplifier 33 is connected to an input *a* of a comparator 51. Connected to the second input *b* of compartor 51 is the output of a reference-value potentiometer 52. The potentiometer 52 is used to set the lowest permissible tobacco density in the filter cigarette ends; as an alternative to discrete reference-value signal generator 52 and separate comparator, use could of course be made of an adjustable threshold circuit, such an adjustable Schmitt trigger or the like.

The output *c* of the comparator 51 is connected to the input *a* of a shift register 53 whose output *c* is connected via a power amplifier 54 to an electromagnetic valve 56 located in conduit 21. The circuit arrangement 36, besides the controllable storage device 34, includes an AND-gate 57 and a NOT-gate or inverter 58. The input *a* of the NOT-gate is connected to the output *c* of compartor 51, whereas the output *c* of NOT-gate 58 is connected with input *a* of the AND-gate 57. The second input *b* of AND-gate 57 is connected to the output of the synchronizer 32, whereas its output *c* is connected to the control or sample-signal input *b* of the controllable storage device 34.

The aforedescribed arrangement operates as follows: The evaluating arrangement 28 applies to the difference amplifier 33 a signal dependent upon the tobacco mass in the cigarette ends *Ze* penetrated by the high-frequency electric field lines joining the measuring-capacitor electrodes 24, 26. This first signal is compared by difference amplifier 33 against the second signal, furnished by the controllable signal generator 41. The difference amplifier 33 generates at its output *c* a third signal corresponding to the difference between the first and second signals. This third signal or difference signal is applied both to the input *a* of controllable storage device 34 and to input *a* of comparator 51.

The comparator 51 determines whether the third signal is lower than the reference signal for which the reference-signal potentiometer 52 has been preset. If this is the case, then the measured tobacco density in the cigarette end *Ze* in question is too low. In that event, the comparator 51 generates at its output *a* defect signal which it applies to input *a* of shift register 53. The shift register 53 is driven by the synchronizer 32, and accordingly the aforementioned defect signal travels through the successive shift-register stages in simulation of the travel of the defective cigarette from the testing station 1 to an ejection station. When the defect signal reaches the shift-register output *c*, it is amplified by power amplifier 54, energizes electromagnetic valve 56, thereby opens the conduit 21 and permits pressurized air from the pump 16 to flow through the conduits 21, 18 and 17, as a result of which the cigarette 3 determined to be defective is blown off the test conveyor 2.

The aforementioned defect signal generated at the output *c* of comparator 51 is furthermore applied to the NOT-gate 58 which inverts it, so that no signal is present at input *a* of AND-gate 57. The input *b* of AND-gate 57 regularly receives synchronizing signals from synchronizer 32. However, if no signal is present at input *a* of AND-gate 57, and AND-gate 57 will no furnish a signal to the transfer-signal input *b* of controllable storage device 34. As a result, the third signal derived from the defective cigarette and applied from the output of difference amplifier 33 to the input *a* of storage 34 is not registered by storage 34, and accordingly will not be transmitted to the averaging circuit 37. Instead, the storage 34 continues to register the third signal derived from the previously tested, non-defective cigarette 3, so that such previous third signal continues to be present unchanged at the output of stage 34 and continues to be applied to the input of averaging circuit 37.

Tobacco moisture fluctuations usually proceed very slowly. Accordingly, the first signals derived by the measuring arrangement 23 from a succession of non-defective filter cigarettes 3 will usually change only very gradully, in response to a gradual change of tobacco moisture. However, if the signal changes attributable to tobacco moisture changes are relatively small from one signal to the next, then the third signal, applied from output *c* of difference amplifier 33 to input *a* of comparator 51, will not fall below the reference-value signal applied to comparator input *b*, so that the comparator 51 will not generate an output signal. So long as the tested cigarettes are all non-defective, if the tobacco moisture increases, resulting in an increase of the first or testing signals applied to input *a* of difference amplifier 33, the third signal, applied to input *a* of comparator 51, will never drop below the reference-value signal applied to comparator input *b*, so that the comparator cannot generate output signals. Accordingly, no signal (a logical "0")will be applied to inverter 58, and a gating signal (a logical "1")will be applied to input *a* of AND-gate 57. As a result, the AND-gate 57 will be enabled and will transfer each synchronizing signal applied to input *b* of AND-gate 57 from the output of synchronizer 32 to the sample-signal input *b* of controllable storage device (sample-and-hold device) 34. Consequently, the third signal (a postive or negative difference signal) present at output *c* of difference amplifier 33 will be sampled and held by controllable storage 34, and accordingly be applied to the input of averaging circuit 37 for the duration of one testing cycle, i.e., for the time interval intermediate two successive synchronizing signals from synchronizer 32. The averaging circuit 37 operates relatively sluggishly, so that its output signal changes only slowly in response to tobacco moisture fluctuations.

Let it be assumed that the tobacco moisture increases. As a result, the difference between the first and second signals, respectively applied to inputs *a* and *b* of difference amplifier 33, will lead to the generation of a negative output signal at difference amplifier output *c*. Assuming that the tobacco moisture stays at the increased level, a succession of such negative output signals will be generated and applied to the averaging device 37. As a result, the averaging circuit output signal will go more and more negative. If this output signal falls below the reference-value signal applied to comparator 44 by reference-signal potentiometer 47, the comparator will generate an output signal. This output signal will be applied via power amplifier 49 to the adjusting motor 39, and the adjusting motor 39 will turn the wiper of the rotary potentiometer 41 in a sense decreasing the output voltage applied to input *b* of difference amplifier 33. This decrease of the second signal causes a decrease in the difference between the first and second signals; i.e., the change of the output signal of difference amplifier 33 atributable to the tobacco moisture change is gradually compensated for by automatically and gradually adjusting the value of the second signal, derived from signal generator 41, to take into account the new tobacco moisture level.

Next, let it be assumed that the tobacco moisture decreases. As a result, the difference amplifier 33 generates a positive output signal. If the tobacco moisture remains at the decreased value, a succession of such positive third signals will be generated and transmitted to the averaging circuit 37, whose output signal will go more and more positive. If this output signal exceeds the reference-value signal supplied to comparator 43 by reference-signal potentiometer 46, then comparator 43 generates an output signal. The comparator output signal is applied via power amplifier 41 to adjusting motor 39, which adjusts the rotary potentiometer 41 in a sense increasing the output signal applied by the latter to input *b* of difference amplifier 33. In the way already described, this likewise effects a compensation for the change in the measured value of the tobacco attributable to the tobacco moisture change. Defective filter cigarettes do not affect the compensation for moisture fluctuations, because the signals derived from them are not transmitted to the averaging device 37.

Instead of determining the absolute moisture of the tobacco and subtracting from the mass measurement signal a signal corresponding to the moisture, it would be possible to detect only the relative moisture, i.e., the deviation from an average value, and then correct the mass measurement signal accordingly; this alternative expedient could be realized quite easily be modifying the illustrated arrangement, for example by changing the reference-value signals.

Figure 2:
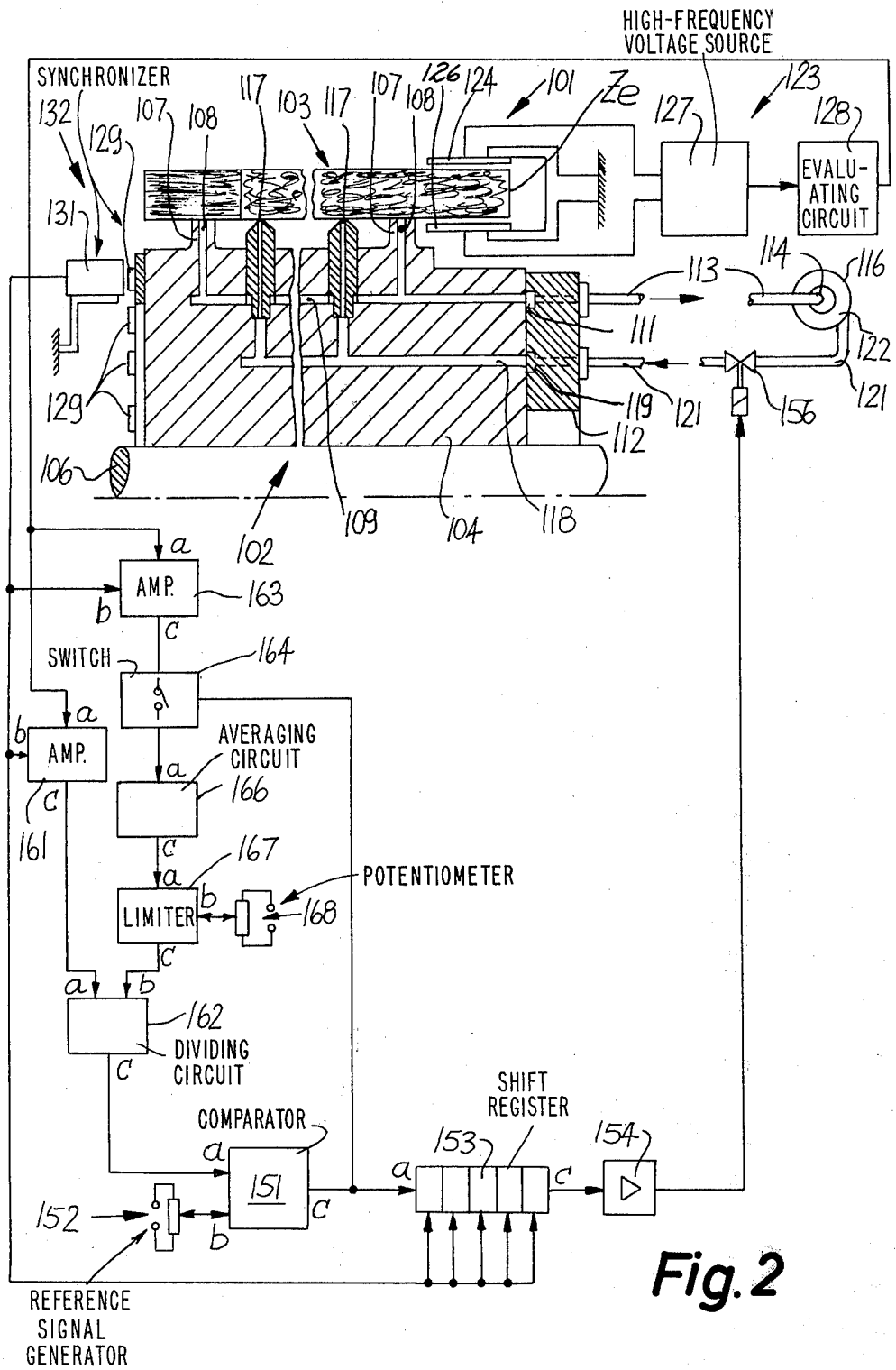

FIG. 2 depicts a modification of the arrangement of FIG. 1, in which parts corresponding to those in FIG. 1 are designated by the same numerals, but increased by and not described again.

The evaluating arrangement 128 is connected with a signal processing arrangement having the form of a dividing circuit 162, via a controllable amplifier 161 connected with the synchronizer 132. The evaluating arrangement 128 is furthermore connected with an averaging device 166, via a controllable amplifier 163 which is likewise connected to the synchronizer 132, and via a circuit arrangement having the form of a controllable switch 164 connected to the output *c* of the comparator 151. The averaging circuit 166 is connected to the second input of the dividing circuit 162, via a limiter 167 (an operational amplifier with a limiting circuit) whose lowest output signal is preselectable by means of a potentiometer 168. The output of the dividing circuit 162 is connected with input *a* of the compartor 151.

The arrangement of FIG. 2, to the extent that its operation differs from that of FIG. 1, operates as follows:

Each synchronizing signal generated by synchronizer 132 causes the controllable amplifiers (sampler-and-hold amplifiers) 161, 163 to register the output signal of the evaluating arrangement 128 which, at the moments of generation of the synchronizing signals, depends upon the mass and moisture of the tobacco in the respective cigarette end *Ze*. The output signal of amplifier 161 is applied to dividing circuit 162, whose second input receives via the limiter 167 the output signal of the averaging device 166. The limiter 167 serves to ensure that the signal applied to the dividing circuit 162 does not fall below a certain minimum value; for example, during the first testing operation, if the output signal of the averaging device 166 is still zero because it has not had a chance to build up, then the dividing circuit 162 will receive a signal corresponding to the lowest acceptable average value.

The dividing circuit 162 divides the signal (second signal) corresponding to the average value of the first signals (the signals appearing at output *c* of sample-and-hold amplifier 163) by the value of the signal (first signal) corresponding to the cigarette end being tested. If the cigarette end being tested corresponds in quality to the average quality currently registered, this quotient will equal 1; if the cigarette end is of greater quality or lesser quality the quotient will be less than 1 or greater than 1, respectively, A signal corresponding to this quotient is transmitted to the comparator 151 where it is compared against the reference value signal supplied by the reference-signal generator 152.

If the signal corresponding to the quotient exceeds the reference-value signal, then the cigarette end of the just measured cigarette does not correspond to the desired quality standard, and the comparator 151 generates at its output *c* a defect signal. This defect signal is applied to the input of shift register 153, and furthermore controls switch 164 to prevent transmission of the corresponding first signal from the amplifier 164 to the averaging device 166. Accordingly, signals derived from cigarettes having defective ends do not reach the averaging device 166.

As already explained in connection with the arrangement of FIG. 1, signal changes attributable to moisture fluctuations in a series of successively measured cigarette ends occur relatively slowly; i.e., the change of the quotient of the average value and the individual-cigarette value attributable to tobacco moisture change does not lead to the exceeding of the reference-value signal supplied to comparator 151 from reference-signal generator 152. As a result, the corresponding individual-cigarette signals from amplifier 163 are transmitted to averaging device 166, via the switch 164, causing the output average signal of averaging device 166 to change in correspondence to the tobacco moisture change. By forming the quotient with the dividing circuit 162 from the average value signal and the individual-cigarette value signal, one excludes the factor by which the tobacco moisture change would otherwise affect the measurement signal.

If the quality of the cigarette ends deteriorates gradually, then the average value formed by the averaging device 166 gradually adjusts itself to the gradually deteriorating quality. As already explained, the signal applied to divider 162, due to the intermediate connection of the limiter 167, cannot fall below the preset minimum value. Accordingly, once this minimum value is reached, if the quality of the cigarette ends decreases further, the output signal of divider 162, corresponding to the aforedescribed quotient, will exceed the reference-value signal supplied by reference-signal generator 152, leading to the generation of a defect signal at the output of comparator 151.

An important advantage of the invention is that it makes it possible to determine, virtually independently of tobacco moisture, which tobacco-filled articles are not sufficiently filled with tobacco at their ends. Although tobacco moisture changes are detected by the same measuring arrangement which ultimately produces the tobacco-mass-indicating (third) signal, articles whose ends are insufficiently filled do not have any information-falsifying effect upon the detection of the tobacco moisture. The invention not only makes it possible to produce measurements which are more exact than those which could be had in the prior art, but furthermore makes it possible to reliably avoid the discarding of non-defective articles.

It will be understood that each of the elements described above, or two or more together, may also find a useful application in other types of circuits and constructions differing from the types described above.

While the invention has been illustrated and described as embodied in an arrangement for assessing the filling of tobacco in the ends of individual filter cigarettes it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A capactive method for determining the density of filling material in rod-shaped smokers' products, components thereof, and analogous rod-shaped articles, particularly for determining the mass of tobacco in cigarettes, groups of cigarettes, the ends of cigarettes, and the like, comprising, in combination, the steps of generating for the respective articles respective first signals dependent upon both the density and the moisture of the filing material; generating a second signal dependent upon the moisture of the filling material; and processing the first and second signals to form for the respective articles respective third signals dependent upon the mass of the filling material but not exhibiting the moisture fluctuation dependency of the corresponding first signals, wherein said step of generating the second signal comprises determining from said third signals which of the articles are defective because they contain insufficient filling material and which are non-defective because they contain sufficient filling material, deriving an average signal from only those first signals derived from non-defective ones of the articles, and deriving the second signal from the average signal.

2. The method defined in claim 1, wherein the deriving of the average signal comprises deriving the average signal from only those third signals derived from non-defective ones of the articles.

3. The method defined in claim 2, wherein the deriving of the average signal comprises applying the third signals to a comparator which generates defect signals when the associated articles are defective, applying the defect signals to a signal transmission circuit arrangement normally operative for transmitting the third signals to an averaging device to prevent the transmission circuit arrangement from transmitting to the averaging device those third signals associated with defective ones of the articles.

4. The method defined in claim 1, wherein said generating of the second signal comprises generating an indefinitely persisting second signal.

5. The method defined in claim 1, wherein said step of processing the first and second signals to form the third signals comprises forming quotient signals from the first and second signals.

6. The method defined in claim 5, wherein the deriving of the average signal comprises deriving the average signal from only those first signals derived from non-defective ones of the articles, including applying the third signals to a comparator which generates defect signals when the associated articles are defective, applying the defect signals to a signal transmission circuit arrangement normally operative for transmitting the first signals to an averaging device to prevent the transmission circuit arrangement from transmitting those first signals associated with defective ones of the articles.

7. An apparatus for determining by capacitive means the density of filling material in rod-shaped smokers' products, components thereof, and anlogous rod-shaped articles, particularly for determining the mass of tobacco in cigarettes, groups of cigarettes, the ends of cigarettes, and the like, comprising, in combination, first signal generating means for generating for the respective articles respective first signals dependent upon both the density and the moisture of the filling material; second signal generating means for generating a second signal dependent upon the moisture of the filling material; and signal processing means for processing the first and second signals to form for the respective articles respective third signals dependent upon the mass of the filling material but not exhibiting the moisture fluctuation dependency of the corresponding first signals, wherein said second signal generating means comprises means for determining from the third signals which of the articles are defective because they contain insufficient filling material and which are non-defective because they contain sufficient filling material, means for deriving an average signal from only those first signals derived from non-defective ones of the articles, and means for deriving the second signal from the average signal.

8. The apparatus defined in claim 7, wherein said means for deriving the second signal from an average comprises means for deriving the second signal from an average of only those of the third signals which are derived from non-defective ones of the articles.

9. The apparatus defined in claim 7, wherein said means for deriving the second signal from an average comprises means operative for generating the second signal in the form of an indefinitely persisting signal.

10. The apparatus defined in claim 9, wherein said means for deriving the second signal from an average includes an averaging device connected to the output of said signal processing means, an evaluating circuit arrangement connected to the output of the averaging device for determining when the output signal of the averaging device reaches a certain value, an adjustable signal generator operative for generating an indefinitely persisting signal constituting the second signal, and adjusting means connected between the output of the evaluating circuit arrangement and the adjustable signal generator for adjusting the latter in dependence upon the operation of the evaluating circuit arrangement.

11. The apparatus defined in claim 7, wherein said means for deriving the second signal from an average includes an averaging device, controllable signal transmission means for transmitting signals to the averaging device, and synchronizing means for synchronizing the transmission of signals by the signal transmission means with the generating of the first signals for respective ones of the articles.

12. The apparatus defined in claim 7, wherein the signal processing means comprises dividing means for forming from the first and second signals quotient signals constituting the third signals.

13. The apparatus defined in claim 7, wherein the means for determining which of the articles are defective and non-defective comprises a comparator having an input connected to the signal processing means for receipt of the third signals and having an output from the supply of defect signals, wherein the means for deriving the second signal from an average includes and averaging device and controllable signal transmission means for transmitting signals to the averaging device and connected to the output of the comparator to be controlled by the comparator.

14. The apparatus defined in claim 7, the apparatus including transport means for transporting the articles to be tested in direction transverse to the elongation of the articles, and wherein the first signal generating means comprises a plurality of stationary electrodes positioned such that the articles to be tested travel through the space intermediate the stationary electrodes and a high-frequency voltage source connected between the electrodes for establishing a high-frequency electric field having field lines joining the electrodes and passing through articles travelling through the space intermediate the electrodes.

* * * * *

UNITED STATES PATENT OFFICE

CERTIFICATE OF CORRECTION

Patent No. 3,999,134 Dated December 21, 1976

Inventor(~~s~~) Heinz-Christen LORENZEN

It is certified that error appears in the above-identified patent and that said Letters Patent are hereby corrected as shown below:

Foremost page, left-hand column, item [73], "Korber" should read --Körber--.

Col. 3, line 57, "7" (first occurrence) should read --3--.

Col. 4, line 18, "constiute" should read --constitute--.

Col. 5, line 28 "compartor" should read --comparator--;
line 68, "a" (italics) should read --a--.

Col. 6, line 19, "no" should read --not--;
line 59, "postive" should read --positive--.

Col. 7, line 57, --100,-- should be inserted after "increased".

Col. 8, line 6, "compartor" should read --comparator--;
line 11, "sampler" should read --sample--;
line 47, "164" should read --163--.

Claim 7, line 3, "anlogous" should read --analogous--.

Claim 13, line 5, "from" should read --for--;
line 8, "and" (first occurrence) should read --an--.

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*